US007008316B1

(12) United States Patent
Pugh

(10) Patent No.: US 7,008,316 B1
(45) Date of Patent: Mar. 7, 2006

(54) ELECTRONIC GAME BOARD ASSEMBLY

(76) Inventor: Kwyne A. Pugh, 1441 Compton Ter., Hillside, NJ (US) 07205

( * ) Notice: Subject to any disclaimer, the term of this patent is extended or adjusted under 35 U.S.C. 154(b) by 194 days.

(21) Appl. No.: 10/676,542

(22) Filed: Oct. 1, 2003

(51) Int. Cl.
*A63F 13/00* (2006.01)

(52) U.S. Cl. ..... 463/10; 273/236

(58) Field of Classification Search ..... 462/30–31, 462/43, 46, 9–10; 273/236–239, 242, 284, 273/287, 288
See application file for complete search history.

(56) References Cited

U.S. PATENT DOCUMENTS 4,350,342 A 9/1982 Barulich
4,369,975 A 1/1983 Tarc
D324,400 S 3/1992 Furnas
5,190,285 A * 3/1993 Levy et al. ..... 463/36
5,374,065 A 12/1994 Motskin
5,563,470 A 10/1996 Li
6,102,397 A * 8/2000 Lee et al. ..... 273/238
6,422,561 B1 7/2002 Schroeder

* cited by examiner

*Primary Examiner*—Kim Nguyen

(57) ABSTRACT

An electronic game board assembly includes a game board for defining a playing surface grid and a plurality of ports connected thereto. The assembly further includes a plurality of player display panels removably connectable to the plurality of ports. An output device includes a mechanism for verifying and displaying player data. Such an output device is connectable to the game board and communicates with the plurality of player display panels for sending player data thereto. The assembly further includes a plurality of game pieces selectively positionable onto the grid. The plurality of game pieces include an interface circuit removably attachable to the grid and further include a smart chip connected to the interface circuit for containing data therein, respectively. The assembly further includes a mechanism for communicating with the plurality of game pieces and for determining data contained therein.

12 Claims, 3 Drawing Sheets

ELECTRONIC GAME BOARD ASSEMBLY

CROSS REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Technical Field

This invention relates to an electronic game board and, more particularly, to an electronic game board including an electronic grid and a plurality of game pieces having predetermined values and being removably connectable to the grid for determining player scores.

2. Prior Art

Prior art attempts disclose a variety of word-forming games and related apparatus, all of which employ a predetermined number of letters from which each player must make a specific selection. Such letters are thereafter used to form words, either by the formation of independent words or by the addition of letters to words already formed either previously by that player, or by one or more of the other players. Unfortunately, such board games are often difficult to play because each player must manually track his/her individual score.

The advent of microelectronics and computers has produced certain electronic games, which simulate the functions of earlier board games, well known in the industry. Games actuated electrically from a digital memory have now become increasingly popular. For example, the game of scrabble, wherein the individual game pieces may be portrayed by symbols on a game board matrix, may include a keyboard for each game player which may be actuated by the player to display moves on the matrix. One of the problems associated with such prior art attempts is that players are limited to playing specific board games and, therefore, a group of players do not have the option of playing multiple board games with one set of playing pieces.

Therefore, it can be appreciate that there exists a need for new and improved electronic board games, which overcome the shortcomings of the prior art.

BRIEF SUMMARY OF THE INVENTION

In view of the foregoing background, it is therefore an object of the present invention to provide a game board assembly whereby individual game pieces actively communicate with the electronic board game for keeping track of player data and for allowing a group of players to various board games. These and other objects, features, and advantages of the invention are provided an electronic game board assembly including a game board having opposed edge portions and a top surface integral therewith. The top surface defines a playing surface grid and further includes a plurality of ports disposed at the opposed edge portions thereof.

The assembly further includes a plurality of player display panels removably connected to the game board via the plurality of ports. An output device includes a mechanism for verifying and displaying player data. Such an output device is connectable to the game board and communicates with the plurality of player display panels for sending player data thereto.

The assembly further includes a plurality of game pieces selectively positionable onto the grid. The plurality of game pieces include an interface circuit removably attachable to the grid and further include a smart chip connected to the interface circuit for containing data therein. The interface circuit preferably includes a plurality of contacts extending downwardly from a bottom surface thereof and is selectively engageable with the grid. Of course, the interface circuit may include alternate methods for transferring data from the plurality of game pieces to the grid. For example, as well known to a person of ordinary skill in the art, such alternate data transfer methods may include one of the following: a radio frequency interface device, a LED interface device, a infrared interface device or a laser interface device.

The assembly further includes a mechanism for communicating with the plurality of game pieces and for determining data contained therein. The communicating and determining mechanism preferably includes a microprocessor, a data bus connected to the microprocessor and the plurality of display panels and the output device, a memory connected to the microprocessor and including a mechanism for temporarily storing player data therein, and a controller operably connected to the microprocessor and including a mechanism for controlling player data. Such a mechanism sends signals to the plurality of display panels and the output device for displaying player data totals thereon.

The assembly further includes a power source connected to the game board and supplies power thereto. Such a power source is preferably attachable to a rear surface of the game board. The assembly may further include a mechanism for providing dictionary software so that each player can verify data definitions and data values. Such a mechanism is preferably connectable to one of the plurality of ports.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
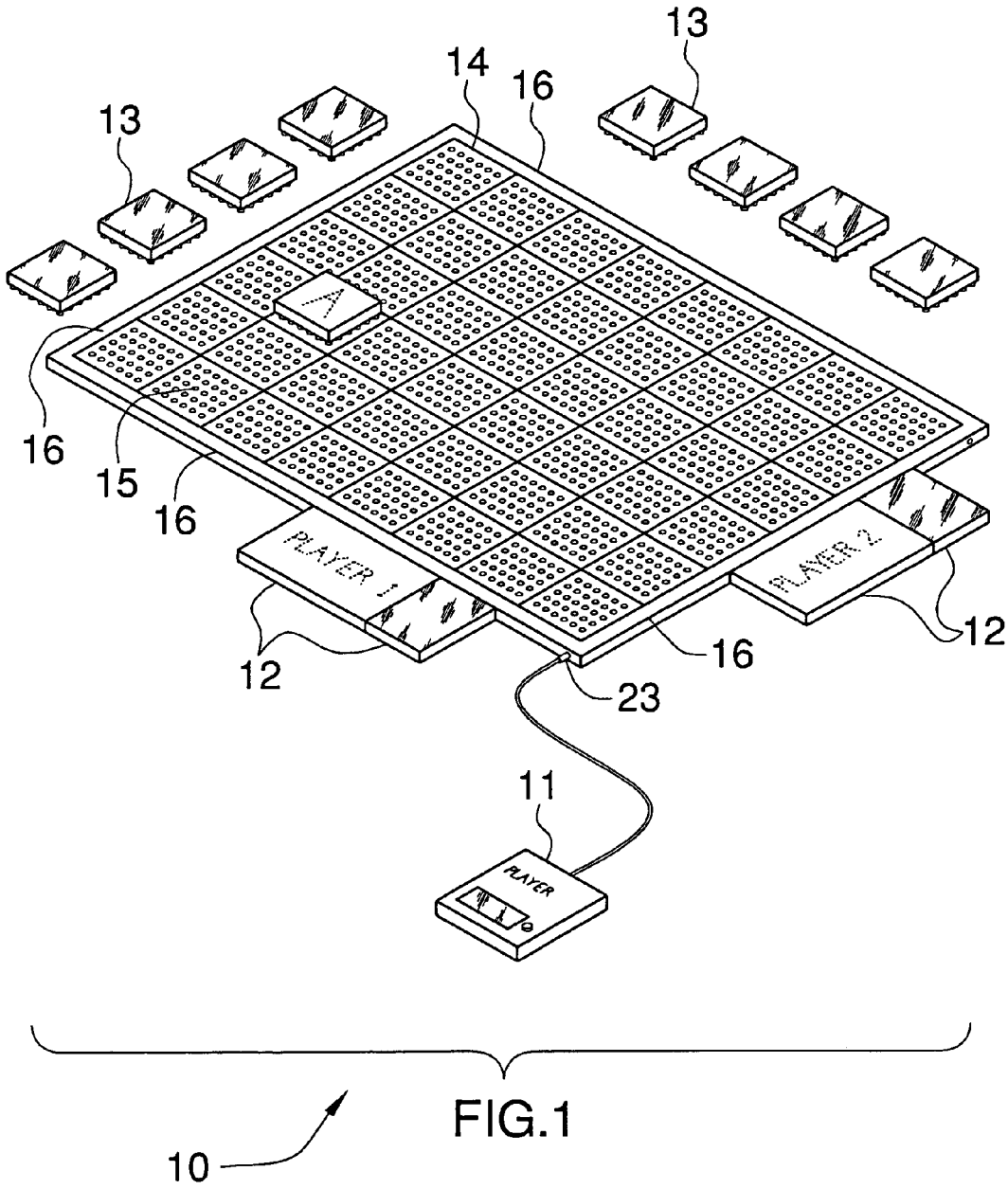
FIG. 1 is a perspective view showing an electronic game board, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art.

The assembly of this invention is referred to generally in FIGS. 1–4 by reference numeral 10 and is intended to provide a game board assembly whereby individual game pieces 13 actively communicate with the electronic game board 14 for keeping track of player data. It should be understood that the assembly 10 may be used to play different types of board games such as word spelling games, chess, and checkers, for example.

The assembly 10 includes a game board 14 having opposed edge portions 16 and a top surface integral therewith. The top surface defines a playing surface grid 15 and further includes a plurality of ports 23 disposed at the opposed edge portions 16 thereof, as perhaps best shown in FIG. 3. The assembly 10 further includes a plurality of player display panels 12 removably connected to the game board 14 via said plurality of ports 23. An output device 11 includes a mechanism for verifying and displaying player data and is connectable to the game board 14 for communicating with the plurality of player display panels 12 and for sending player data thereto.

Figure 2:
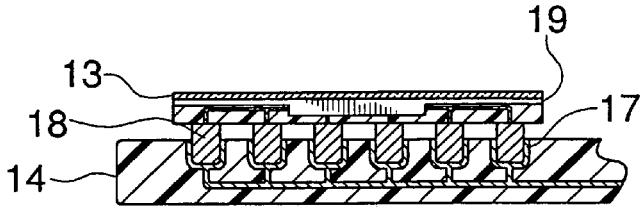
FIG. 2 is an enlarged cross-sectional view of a game piece shown in FIG. 1.
Figure 3:
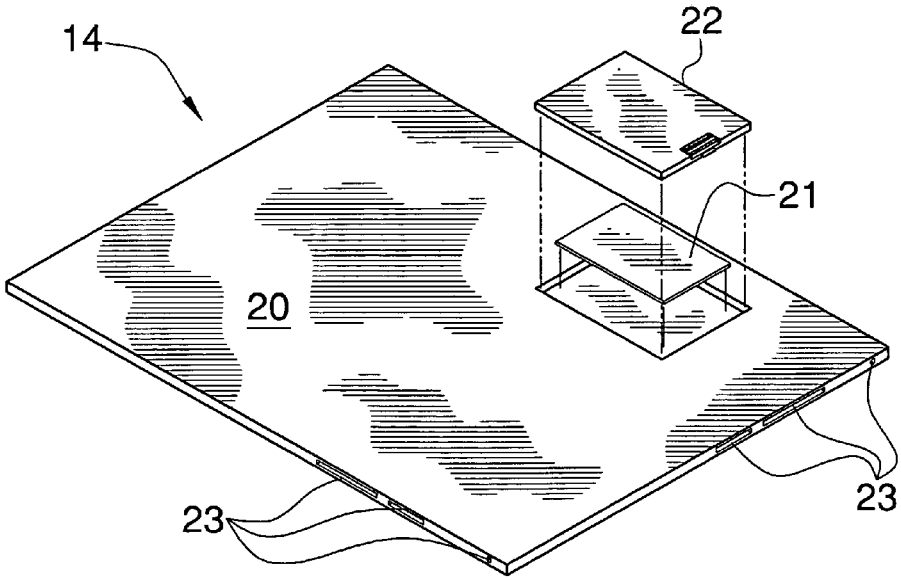
FIG. 3 is a perspective view showing a power supply source disposed at a rear side of the game board shown in FIG. 1.

Referring to FIG. 2 in more detail, the assembly 10 further includes a plurality of game pieces 13 selectively positionable onto the grid 15. The plurality of game pieces 13 include an interface circuit 17 removably attachable to the grid 15 and further include a smart chip 19 connected to the interface circuit 15 and for containing data therein. The interface circuit 17 preferably includes a plurality of contacts 18 extending downwardly from a bottom surface thereof and that are selectively engageable with the grid 15. Of course, the interface circuit 17 may include alternate methods for transferring data from the plurality of game pieces 13 to the grid 15. For example, as well known to a person of ordinary skill in the art, such alternate data transfer methods may include one of the following: a radio frequency interface device (not shown), a LED interface device (not shown), an infrared interface device (not shown) or a laser interface device (not shown).

Figure 4:
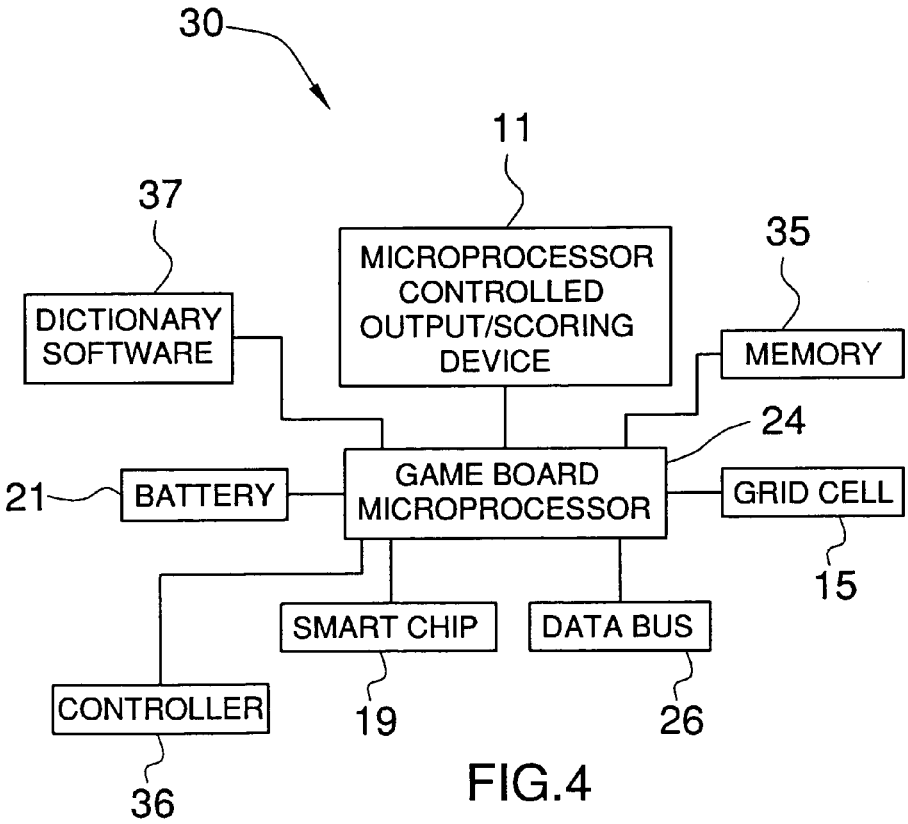
FIG. 4 is a schematic diagram showing the relationship between the major components of the present invention.

Now referring to FIG. 4, the assembly 10 further includes a mechanism 30 for communicating with the plurality of game pieces 13 and for determining data contained therein. The communicating and determining mechanism 30 preferably includes a microprocessor 24, a data bus 26 connected to the microprocessor 24 and the plurality of display panels 23 and the output device 11. Mechanism 30 further includes a memory 35 connected to the microprocessor 24, which includes a mechanism for temporarily storing player data therein, and a controller 36 operably connected to the microprocessor 24, which includes a mechanism for controlling player data. Such a mechanism 36 sends signals to the plurality of display panels 12 and the output device 11 for displaying player data totals thereon.

The assembly 10 further includes a power source 21 connected to the game board 14 and supplies power thereto. Such a power source 21 is preferably attachable to a rear surface 20 of the game board 14. The assembly 10 may further include a mechanism 37 for providing dictionary software so that data definitions and data values can be verified. Such a mechanism 37 is preferably connectable to one of the plurality of ports 23.

In operation, the grid 15 selectively receives the plurality of game pieces including the smart chips 19, as determined by a player. The data bus 26, which is internally disposed within the game board 14, directs the flow of information stored in the plurality of game pieces 13 to the microprocessor 24 and controller 36. The controller 36 keeps track of game piece 13 locations and progressions, then determines scores for each player base upon the data contained in each respective smart chip 19.

Each tile or game piece 13 is assigned a predetermined value. If a blank game piece 13 is played, the assembly 10 will prompt the player to chose a letter to complete the word. The player may select a letter from an alpha/numeric keypad (not shown) connectable to the controller 36, for example. Preliminary player scores may be flashed on the output device 11 to allow for an opponent to challenge the score. If the score is accepted, then the receiving player's score is increased accordingly.

Furthermore, the controller 36 is preprogrammed for interchanging control software via a flash memory card or other media memory such as memory 25, for example, which permits a single electronic board game 14 to be used to play many different board games. For example, by changing software 37 and individual game pieces 13, the present invention, can be converted from a word spelling game to a chess game, or another board game based upon the grid 15 layout.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An electronic game board assembly comprising:

a game board including opposed edge portions and a top surface integral therewith and for defining a playing surface grid, said game board further including a plurality of ports disposed at said opposed edge portions;

a plurality of player display panels being removably connected to said game board;

an output device including means for verifying and displaying player data, said output device being connectable to said game board and for communicating with said plurality of player display panels and for sending said player data thereto;

a plurality of game pieces selectively positionable onto said grid, each of said plurality of game pieces including an interface circuit removably attachable to said grid and further including a smart chip connected to said interface circuit and for containing data therein;

means for communicating with said plurality of game pieces and for determining said data contained therein, said communicating and determining means sending signals to said plurality of display panels and said output device for displaying player data totals thereon;

a power source connected to said game board and for supplying power thereto; and dictionary means being connectable to one said plurality of ports and for providing data definitions and verifying data values.

2. The assembly of claim 1, wherein said communicating and determining means comprises:

a microprocessor;

a data bus connected to said microprocessor and said plurality of display panels and said output device;

a memory connected to said microprocessor and including means for temporarily storing said player data therein; and a controller operably connected to said microprocessor and including means for controlling said player data.

3. The assembly of claim 1, wherein said power source is attachable to a rear surface of said game board.

4. The assembly of claim 1, wherein said interface circuit comprises a plurality of contacts extending downwardly from a bottom surface thereof and for being selectively engageable with said grid.

5. The assembly of claim 1, wherein said interface circuit comprises one of a radio frequency interface device, LED interface device, infrared interface device and laser interface device for selectively communicating with said grid.

6. An electronic game board assembly comprising:

a game board including opposed edge portions and a top surface integral therewith and for defining a playing surface grid, said game board further including a plurality of ports disposed at said opposed edge portions;

a plurality of player display panels being removably connected to said game board;

an output device including means for verifying and displaying player data, said output device being connectable to said game board and for communicating with said plurality of player display panels and for sending said player data thereto;

a plurality of game pieces selectively positionable onto said grid, each of said plurality of game pieces including an interface circuit removably attachable to said grid and further including a smart chip connected to said interface circuit and for containing data therein, said interface circuit including a plurality of contacts extending downwardly from a bottom surface thereof and for being selectively engageable with said grid;

means for communicating with said plurality of game pieces and for determining said data contained therein, said communicating and determining means sending signals to said plurality of display panels and said output device for displaying player data totals thereon; and a power source connected to a rear surface of said game board and for supplying power thereto; and dictionary means being connectable to one said plurality of ports and for providing data definitions and verifying data values.

7. The assembly of claim 6, wherein said communicating and determining means comprises:

a microprocessor;

a data bus connected to said microprocessor and said plurality of display panels and said output device;

a memory connected to said microprocessor and including means for temporarily storing said player data therein; and a controller operably connected to said microprocessor and including means for controlling said player data.

8. The assembly of claim 6, wherein said interface circuit comprises one of a radio frequency interface device, LED interface device, infrared interface device and laser interface device for selectively communicating with said grid.

9. An electronic game board assembly comprising:

a game board including opposed edge portions and a top surface integral therewith and for defining a playing surface grid, said game board further including a plurality of ports disposed at said opposed edge portions;

a plurality of player display panels being removably connected to said game board;

an output device including means for verifying and displaying player data, said output device being connectable to said game board and for communicating with said plurality of player display panels and for sending said player data thereto;

a plurality of game pieces selectively positionable onto said grid, each of said plurality of game pieces including an interface circuit removably attachable to said grid and further including a smart chip connected to said interface circuit and for containing data therein, said interface circuit including a plurality of contacts extending downwardly from a bottom surface thereof and for being selectively engageable with said grid;

means for communicating with said plurality of game pieces and for determining said data contained therein, said communicating and determining means sending signals to said plurality of display panels and said output device for displaying player data totals thereon;

a power source connected to said game board and for supplying power thereto; and dictionary means being connectable to one said plurality of ports and for providing data definitions and verifying data values.

10. The assembly of claim 9, wherein said communicating and determining means comprises:

a microprocessor;

a data bus connected to said microprocessor and said plurality of display panels and said output device;

a memory connected to said microprocessor and including means for temporarily storing said player data therein; and a controller operably connected to said microprocessor and including means for controlling said player data.

11. The assembly of claim 9, wherein said power source is attachable to a rear surface of said game board.

12. The assembly of claim 9, wherein said interface circuit comprises one of a radio frequency interface device, LED interface device, infrared interface device and laser interface device for selectively communicating with said grid.

* * * * *